US007175010B1

(12) United States Patent
Miner

(10) Patent No.: US 7,175,010 B1
(45) Date of Patent: Feb. 13, 2007

(54) COLLAPSIBLE LUGGAGE

(76) Inventor: Michelle Yvette Miner, 5400 Brook Hollow Ct., Concord, CA (US) 94521

( * ) Notice: Subject to any disclaimer, the term of this patent is extended or adjusted under 35 U.S.C. 154(b) by 69 days.

(21) Appl. No.: 10/781,100

(22) Filed: Feb. 17, 2004

(51) Int. Cl.
*A45C 7/00* (2006.01)
*A45C 13/10* (2006.01)

(52) U.S. Cl. ..... 190/107; 190/901; 190/902; 220/6; 383/2

(58) Field of Classification Search ..... 190/107, 190/901, 903; 220/4.29, 6; 383/2
See application file for complete search history.

(56) References Cited

U.S. PATENT DOCUMENTS

| | | | | | |
|---|---|---|---|---|---|
| 621,824 | A * | 3/1899 | Kleeman | 190/107 |
| 736,871 | A * | 8/1903 | O'Brien | 190/107 |
| 841,902 | A * | 1/1907 | Shumard | 190/107 |
| 1,306,136 | A * | 6/1919 | Carpenter et al. | 220/6 |
| 1,354,928 | A * | 10/1920 | Watson | 220/6 |
| 1,673,769 | A * | 6/1928 | Graham | 220/6 |
| 1,793,362 | A * | 2/1931 | Graves | 220/6 |
| 2,416,783 | A * | 3/1947 | Vallieres | 190/107 |
| 2,485,028 | A * | 10/1949 | Bauernfreund et al. | 220/6 |
| 2,768,719 | A * | 10/1956 | Samuel | 190/107 |
| 3,262,283 | A * | 7/1966 | Taylor | 62/372 |
| 3,658,035 | A * | 4/1972 | Harris | 119/269 |
| 3,814,220 | A * | 6/1974 | Brody | 190/19 |
| 4,126,213 | A * | 11/1978 | McDonald | 190/18 A |
| 4,305,519 | A * | 12/1981 | Gerich | 220/7 |
| 4,984,906 | A * | 1/1991 | Little | 383/4 |
| 5,328,042 | A * | 7/1994 | Heise | 220/7 |
| 5,758,751 | A * | 6/1998 | Charles | 190/107 |
| 5,904,230 | A * | 5/1999 | Peterson | 190/107 |
| 6,209,723 | B1 * | 4/2001 | Fields | 206/373 |
| 6,216,899 | B1 * | 4/2001 | Vicari | 220/1.5 |
| RE37,915 | E * | 12/2002 | Lapoint, III | 229/117.35 |

* cited by examiner

*Primary Examiner*—Sue A. Weaver
(74) *Attorney, Agent, or Firm*—Risto A. Rinne, Jr.

(57) ABSTRACT

An apparatus for the protection and transportation of cargo includes a planar bottom, four upright sides that are hingedly attached to the planar bottom and a top member that preferably is detachable. The four upright sides includes flexible corners that permit them to fold down on top of the planar bottom. The top is then secured over the collapsed upright sides for storage of the apparatus. To use the apparatus, the upright sides are raised, the cargo is placed on top of the planar bottom intermediate the upright sides, and the top is secured in position over the cargo and the top edges of the upright sides.

17 Claims, 4 Drawing Sheets

COLLAPSIBLE LUGGAGE

BACKGROUND OF THE INVENTION

1. Field of the Invention

The present invention, in general relates to luggage and, more particularly, to a collapsible article of luggage.

Luggage comes in a variety of well known styles and sizes. Some types of luggage include zippers than are opened to allow a section to expand in order to create more storage space.

When people travel, they rely on luggage. Some types of luggage are used for short day trips, like attaché cases or small carry-on types of luggage. Others are large and intended for the transport of more objects.

When they are home, their luggage takes up considerable space. It is desirable to be able to store their luggage in a compact space.

Also, sometimes when people vacation, they purchase souvenirs and other objects to bring back on their return. They often need more carrying capacity on a return trip than on the outgoing trip. Consequently, it is not uncommon to take an empty suitcase with them, yet this takes up valuable travel space.

Sometimes, people bring a collapsible duffel bag inside their primary luggage, but duffel bags do not provide any rigidity or protection to articles that are placed inside.

Accordingly, there exists today a need for collapsible luggage.

Clearly, such an apparatus would be a useful and desirable device.

2. Description of Prior Art

Luggage is, in general, well known. While the structural arrangements of the known types of devices, at first appearance, may have certain similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a collapsible luggage that is useful in carrying cargo items.

It is also an important object of the invention to provide a collapsible luggage that includes a first open position that is useful for carrying cargo and a second collapsed position for storage of the luggage.

Another object of the invention is to provide a collapsible luggage that collapses into a compact volume when not in use.

Still another object of the invention is to provide a collapsible luggage that includes at least a rigid portion attached to each side.

Still yet another object of the invention is to provide a collapsible luggage that includes sides that are hingedly attached with respect to a planar bottom member.

Yet another important object of the invention is to provide a collapsible luggage that includes a top member that is adapted to cover an opening into the luggage.

Still yet another important object of the invention is to provide a collapsible luggage that includes flexible corners.

Briefly, a collapsible luggage that is constructed in accordance with the principles of the present invention has a planar bottom, four upright sides that are hingedly attached to the planar bottom and a top member that preferably is detachable. The four upright sides includes flexible corners that permit them to fold down on top of the planar bottom. The top is then secured over the collapsed upright sides for storage of the luggage. To use the luggage, the upright sides are raised, the cargo is placed on top of the planar bottom intermediate the upright sides, and the top is secured in position over the cargo and the top edges of the upright sides.

DETAILED DESCRIPTION OF THE INVENTION

Figure 1:
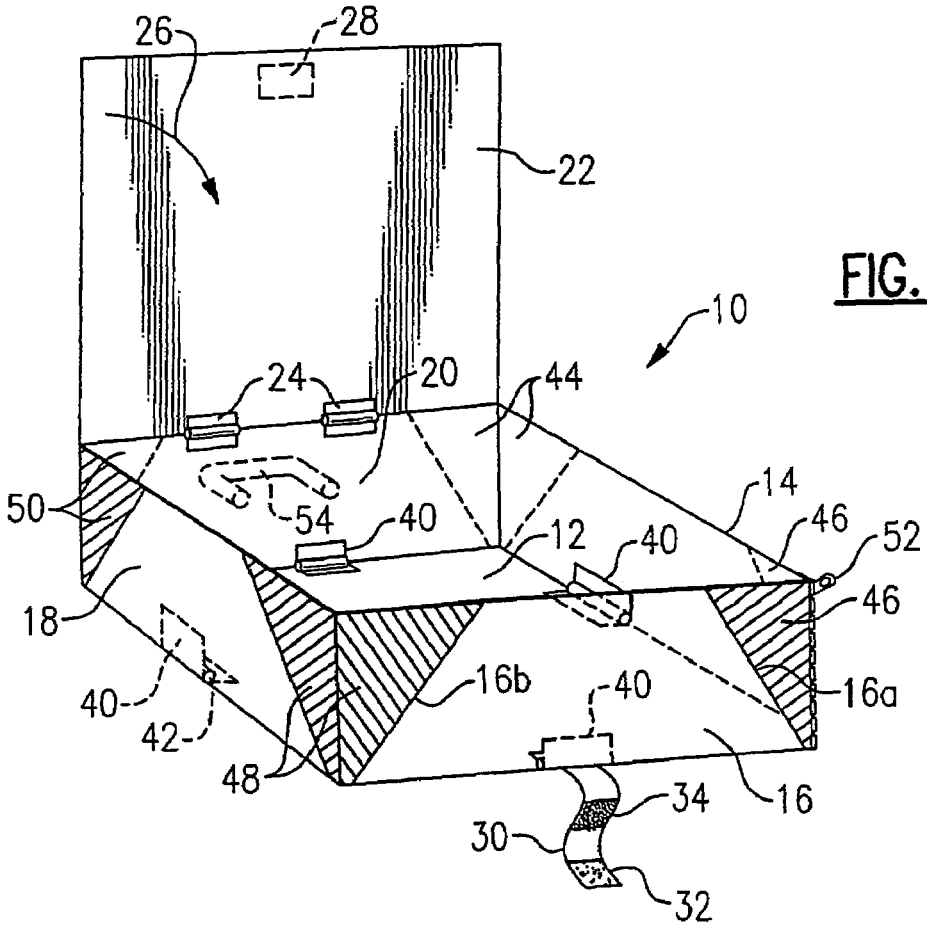
FIG. 1 is a view in perspective of a collapsible luggage.
Figure 5:
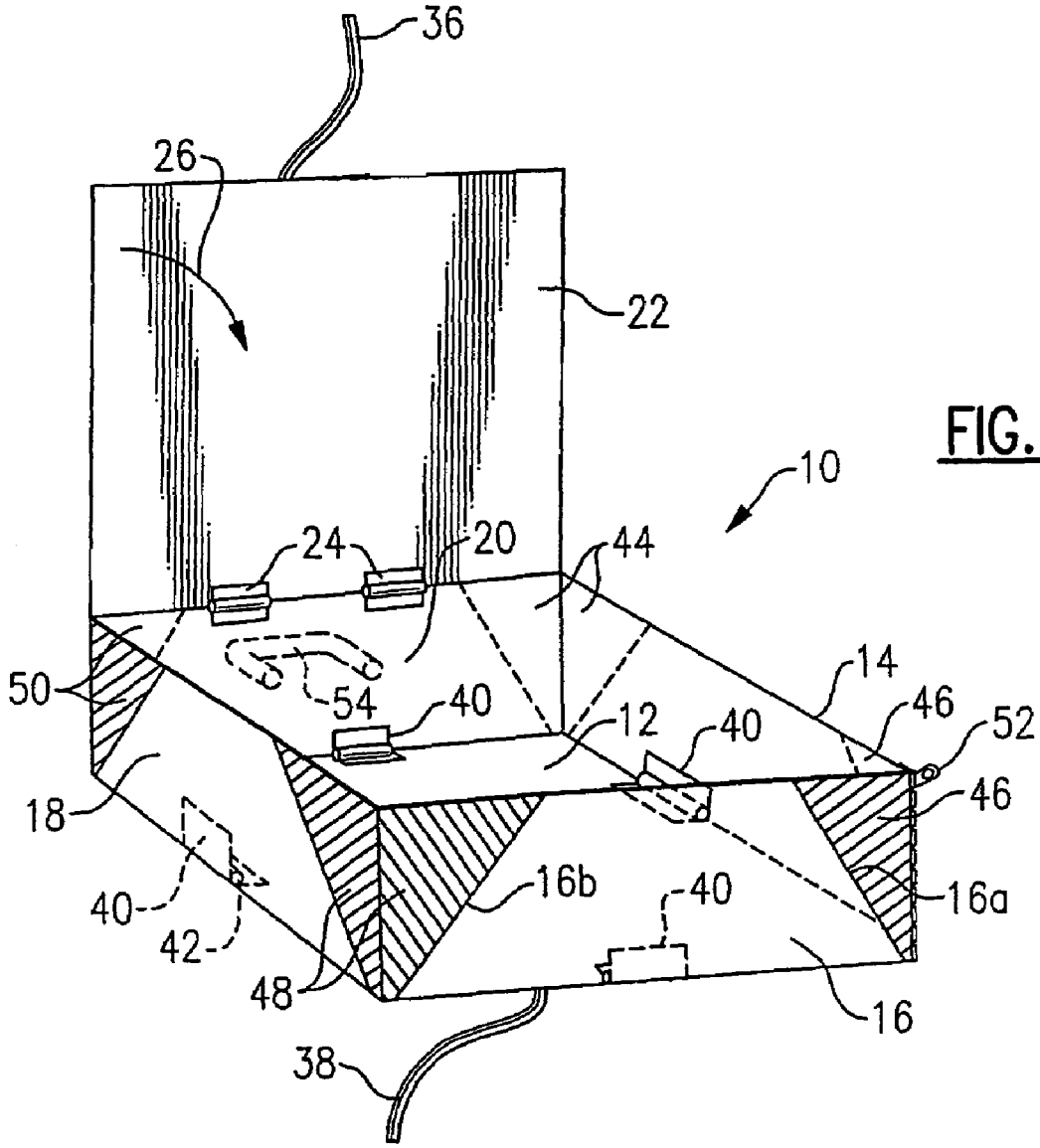
FIG. 5 is a view in perspective of certain modifications to the collapsible luggage of FIG. 1.

Referring to all of the drawings and now in particular to FIG. 1 is shown, a collapsible luggage, identified in general by the reference numeral 10 shown in the open position. Please refer also to FIG. 5 for an illustration of proposed modifications that can be made to the collapsible luggage of FIG. 1.

The luggage 10 includes a planar bottom 12, and four planar upright sides 14, 16, 18, 20 that are perpendicular with respect to the planar bottom 12 when the luggage 10 is in the open position.

A hinged planar top 22 is parallel to the planar bottom 12 and disposed a distance therefrom that is equal to the height of the upright sides 14–20.

The top 22 includes a pair of top hinges 24 that form an axis about which the top 22 can rotate from the open position (shown) into a closed position as indicated by movement along a direction as shown by arrow 26 until it is on top of the upright sides 14–20 and parallel with the planar bottom 12.

There are many ways of securing the luggage 10 in either the open position or in the collapsed position (which is described in greater detail hereinafter). One such way includes the use any well known latch mechanism.

An alternative way includes the use of a hook and loop member 28 disposed on top of the top 22 and a strap 30 that is attached at one end to the planar bottom 12. The strap 30 includes a pair of corresponding opposite hook and loop members 32, 34 that are adapted to adhere with the hook and loop member 28 if pressed together.

The first of the corresponding opposite hook and loop members 32 is used to secure the top 22 in the closed position when the luggage 10 is in the open position. The second of the corresponding opposite hook and loop members 34 is used to secure the top 22 in the closed position when the luggage 10 is in the closed position.

Of course still other ways of closure may be utilized. For example, the strap 30 can be omitted and replaced with a first tie strap 38. Similarly, the hook and loop member 28 can be omitted and replaced with a second tie strap 36. The first and second tie straps 38, 36 are then tied together as desired to secure the top 22 in the closed position whether the luggage 10 is in the open or in the collapsed position.

The planar bottom 12, the upright sides 14–20, and the top 22 are all formed of a rigid material. This is important because it helps the luggage 10 form a substantially rigid structure when in the open position. This provides optimum protection for articles that are placed in the luggage 10.

Each of the upright sides 14–20 is preferably attached to the planar bottom 12 by the use of at least one side hinge 40. More than one side hinge 40 can of course be used. Each side hinge 40 can include a spring 42, if desired, to supply a force that tends to urge each of the upright sides 14–20 downward toward the center of the planar bottom 12 and parallel thereto. This is useful in collapsing the luggage 10.

Each of the upright sides 14–20 includes a flexible corner 44, 46, 48, 50 on each end thereof. Each of the upright sides 14–20 includes an angled end, as illustrated by a first end 16*a* and a second end 16*b*.

The angled ends 16*a*, 16*b* of all of the upright sides 14–20 are at a forty-five degree angle or less with respect to an edge of the upright sides 14–20 where each side hinge 40 is attached. This allows the upright sides to fold inward (see FIG. 3) without any of the upright sides 14–20 making contact (i.e., being on top of) an adjacent one of the upright sides 14–20. This results in attaining minimum size in the collapsed position (see FIG. 2).

Figure 2:
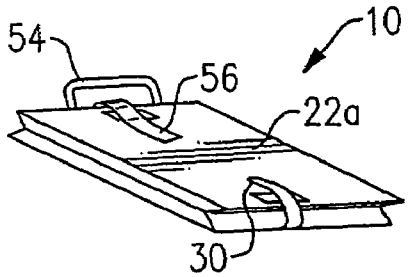
FIG. 2 is a view in perspective of the collapsible luggage of FIG. 1 in a collapsed state.
Figure 3:
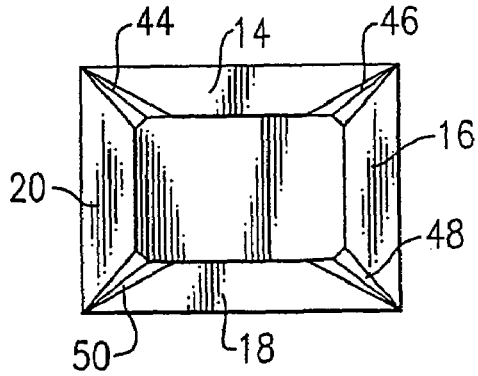
FIG. 3 is a top view of the luggage of FIG. 1 in a collapsed position absent a top panel.

Each of the flexible corners 44–50 is made of fabric or other flexible material. If desired, a zipper 52 can be used to separate the corners to make it easier to fold the luggage 10 into the collapsed position as shown in FIG. 2. If the zipper 52 is used, it is possible to eliminate most of the flexible corners 44–50 except for a small portion where the sides of the zipper 52 attach to the upright sides 14–20. This permits almost the entire length of each of the upright sides 14–20 to be rigid.

A handle 54 is attached to any of the upright sides 14–20 and is used to carry the luggage in either the open or the collapsed positions.

Referring now in particular to FIG. 2, a modified top 22*a* is shown. The modified top 22*a* is not attached by the top hinges 24 to the upright side 20. Instead, a second strap 56 that is constructed identical to the strap 30 is used on the other side to secure the modified top 22*a* in the closed position in either the open or the collapsed positions.

The modified top 22*a* provides two benefits. The first benefit is that it can be removed entirely from the luggage 10 during loading and unloading. This makes it easier as the modified top 22*a* cannot possibly be in the way. The second benefit is that the modified top 22*a* rests flat on top of the luggage 10 in the collapsed position without extending beyond one of the upright sides 16, as would the top 22.

Other ways of attaching a still further modified top are anticipated. For example, the further modified top (not shown) could include a zipper all around that connects with the top edges of four modified upright sides, thereby providing maximum containment of any cargo placed therein.

Figure 4:
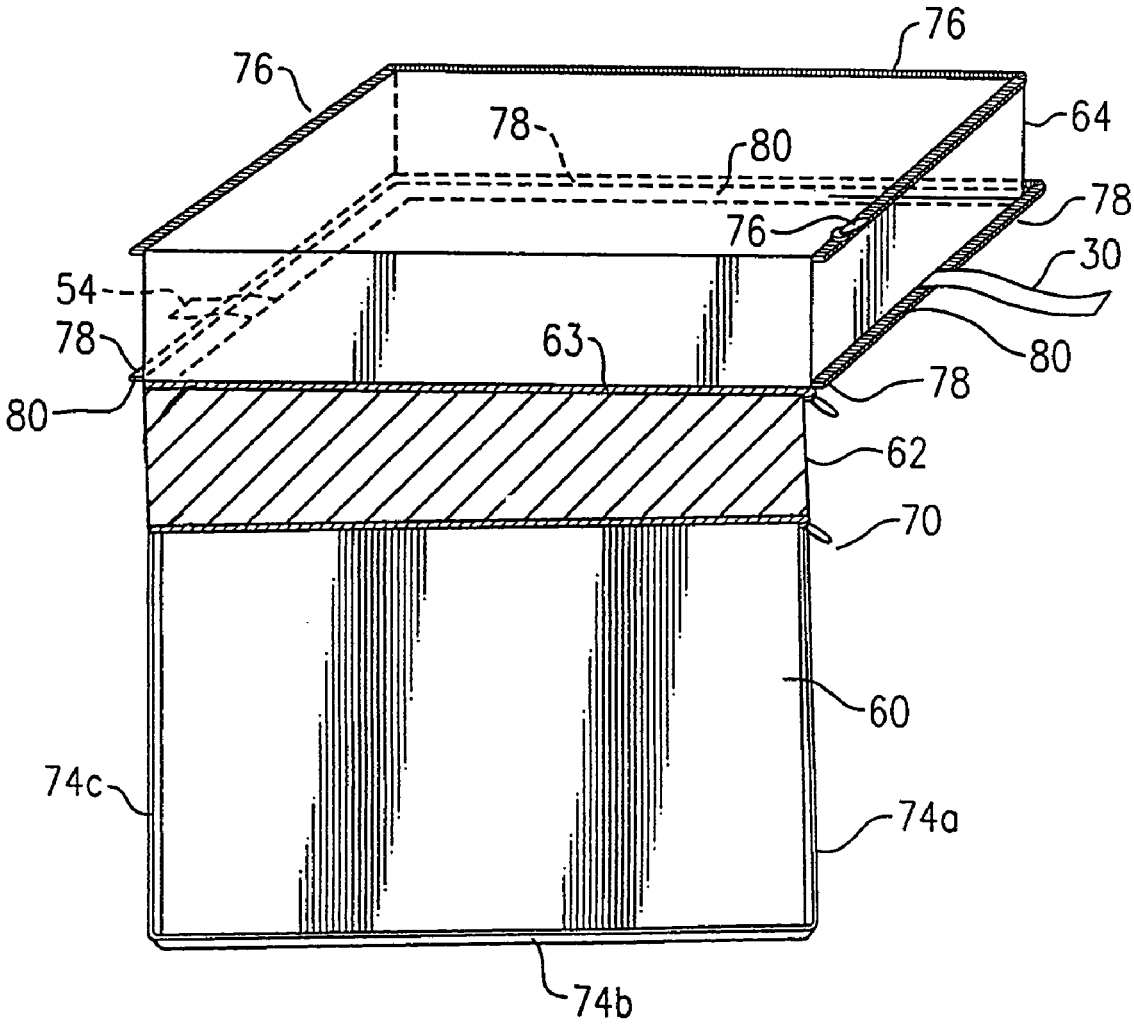
FIG. 4 is a view in perspective of a modified top for use with a collapsible luggage.
Figure 6:
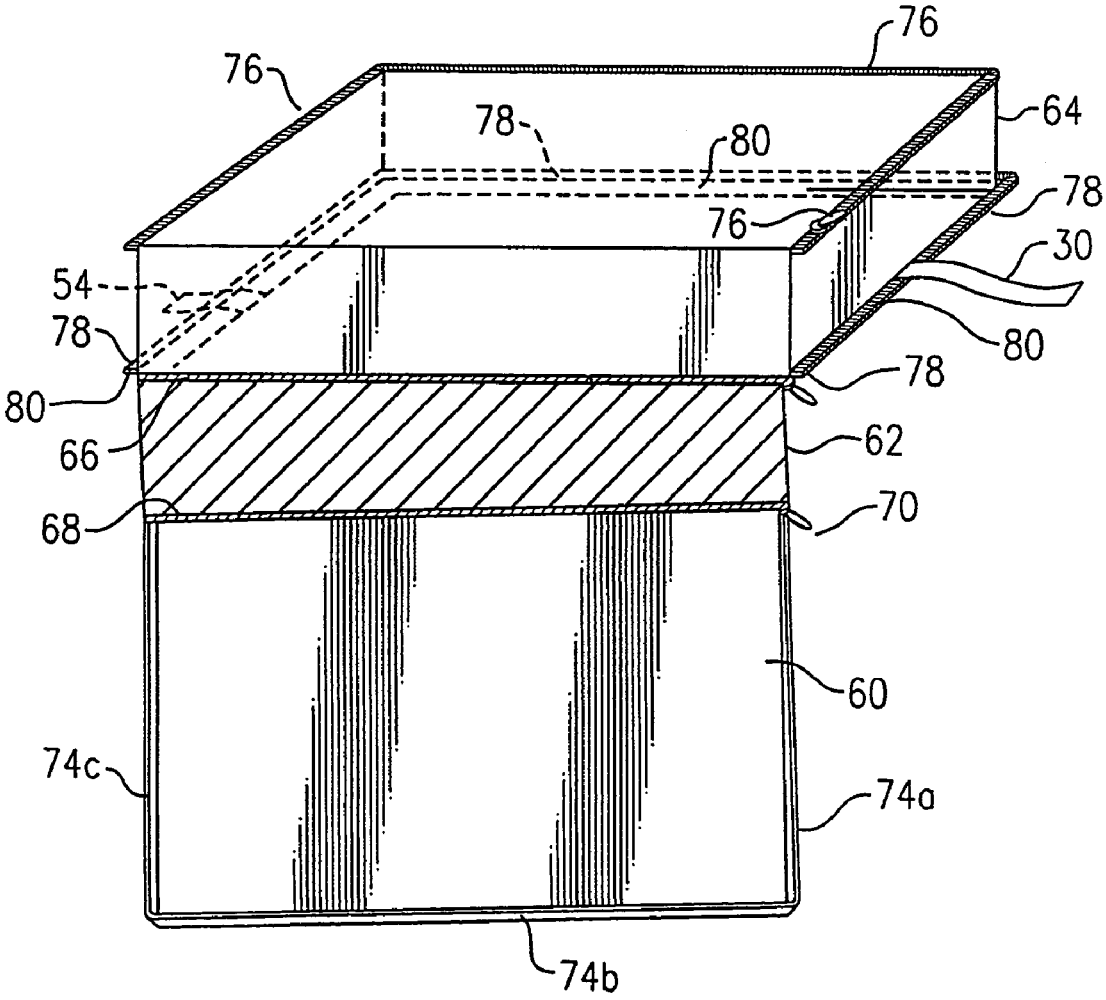
FIG. 6 is a view in perspective of the modified top of FIG. 4 with additional modifications thereto.

Referring now to FIG. 4, a second modified top 60 is attached to a modified side panel 62. The side panel 62 is attached to a bottom edge 63 of a modified collapsible luggage 64. The side panel 62 is either solid or flexible, as desired. Please refer also to FIG. 6 for an illustration of proposed modifications that can be made to the collapsible luggage of FIG. 1.

The side panel 62 can remain attached to the bottom edge 63 or it can be modified so that it can be detached from the bottom edge 63 by an edge zipper 66 that folds in toward the second modified top 60. When the second modified top 60 is placed on top of the modified collapsible luggage 64, it does not extend beyond the overall size.

If preferred, an alternate edge zipper 68 could be attached between the side panel 62 and the second modified top 60 providing a similar benefit.

If the side panel 62 is not detachable, then the edge zipper 66 and the alternate edge zipper 68 are eliminated and the flexible side panel 62 is folded underneath the modified top 60 and the rest of the modified collapsible luggage 64 when it is compressed.

There are numerous modifications that are possible. This disclosure can describe but a few of these many possibilities. For example, wheels could be added, as is well known in the luggage arts, to allow for easier transportation when the collapsible luggage 10 (or any modification thereof) is loaded. As another example, any combination of rigid or flexible material can be used. For example, the same flexible material that the flexible corners 44–50 are made of could also be used to form the remainder of the collapsible luggage 10. any of the hinges herein described can be distinct hinges that are added (for example to rigid portions of the luggage 10) or they may be formed of the flexible material that also acts as a hinge.

Another method to secure the second modified top 60 of the modified collapsible luggage 64 (or the top 22 of the collapsible luggage 10) in both the closed position and the collapsed positions is shown in FIG. 4 in which a first half of a perimeter zipper 70 is attached around at least a portion of the second modified top 60. Preferably it extends around three sides 74*a*, 74*b*, and 74*c*, as shown.

A first corresponding second half of a perimeter zipper 76 is attached to the top rim (i.e., the top edges of three of the sides) of the modified collapsible luggage 64. The first corresponding second half of a perimeter zipper 76 mates with the first half of a perimeter zipper 70 to secure the second modified top 60 in a closed position when the modified collapsible luggage 64 is being used to transport items. If the three sides 74*a*, 74*b*, and 74*c* are secured by the zippers 70, 76 and the remaining edge is attached to the side panel 62, then the items in the modified collapsible luggage 64 are retained therein.

A second corresponding second half of a perimeter zipper 78 is attached to a first side of an intermediate section of fabric 80. The intermediate section of fabric 80 includes an opposite side that is attached to the bottom of the modified collapsible luggage 64. The intermediate section of fabric 80 and the second corresponding second half of a perimeter zipper 78 extends around a bottom perimeter of the modified collapsible luggage 64 so as to align generally below the first half of a perimeter zipper 70.

The second corresponding second half of a perimeter zipper 78 is adapted to also mate (i.e., cooperate) with the first corresponding perimeter zipper 76 to secure the modified collapsible luggage 64 in the collapsed position. The intermediate section of fabric 80 allows room for the collapsed portions of the modified collapsible luggage 64 that are compressed between the second modified top 60 and the bottom of the modified collapsible luggage 64.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A collapsible luggage, comprising:

(a) a planar bottom formed of a substantially rigid material;

(b) four upright sides that are each hingedly attached at one end thereof to the planar bottom, and wherein each of the upright sides is adapted to pivot from a first upright position adapted for the transport of cargo in said collapsible luggage in which each of said upright sides is substantially perpendicular with respect to a plane of said planar bottom into a second collapsed position in which each of said upright sides is adjacent to and substantially parallel with respect to said plane of said planar bottom; and (c) a planar top that is adapted to cover an opening on top of said collapsible luggage when said collapsible luggage is in said first position and in said second position, and including a first half of a perimeter zipper that is attached to at least a portion of said top and including a first corresponding second zipper half that is adapted to mate with said first half of a perimeter zipper and wherein said first corresponding second zipper half is attached proximate a bottom edge of at least a portion of any of said four upright sides sufficient to secure said top to at least one of said bottom edge when said collapsible luggage is in said second collapsed position.

2. The collapsible luggage of claim 1 wherein each of said upright sides includes a flexible corner intermediate an end of any two of said adjacent upright sides.

3. The collapsible luggage of claim 2 wherein each flexible corner is made of a fabric.

4. The collapsible luggage of claim 2 wherein each flexible corner is made of a flexible material.

5. The collapsible luggage of claim 2 wherein each flexible corner includes means for separating said flexible corner into two halves.

6. The collapsible luggage of claim 5 wherein said means for separating said corner includes a zipper.

7. The collapsible luggage of claim 6 wherein said zipper is disposed in a flexible fabric.

8. The collapsible luggage of claim 1 wherein each adjacent pair of upright sides includes a corner and wherein said corner includes means for separating said corner into two halves.

9. The collapsible luggage of claim 8 wherein said means for separating said corner includes a zipper.

10. The collapsible luggage of claim 1 wherein said planar top is detachable with respect to a remainder of said collapsible luggage.

11. The collapsible luggage of claim 1 including means for retaining said planar top to said collapsible luggage.

12. The collapsible luggage of claim 11 wherein said means for retaining said planar top includes a first tie strap attached to said planar top and a second tie strap attached to a remainder of said collapsible luggage and wherein said first tie strap is adapted to be fastened to said second tie strap sufficient to retain said planar top.

13. The collapsible luggage of claim 11 wherein said means for retaining said planar top includes a first strap attached to said collapsible luggage at a location other than at said planar top and wherein said first strap includes fastening means adapted for securing said first strap to said planar top.

14. The collapsible luggage of claim 13 wherein said means for retaining said planar top includes a second strap attached to said collapsible luggage at a location other than at said planar top and at a location other than where said first strap is attached and wherein said second strap includes fastening means adapted for securing said second strap to said planar top.

15. The collapsible luggage of claim 13 wherein said fastening means includes a first half of a hook and loop fastener attached to said first strap and a second half of said hook and loop fastener attached to said planar top, wherein said first half and said second half are adapted to adhere together when pressed together.

16. The collapsible luggage of claim 14 wherein said fastening means includes a first half of a hook and loop fastener attached to said second strap and a second half of said hook and loop fastener attached to said planar top, wherein said first half and said second half are adapted to adhere together when pressed together.

17. The collapsible luggage of claim 1 including a first half of a perimeter zipper that is attached to at least a portion of said top and including a second corresponding second half of a perimeter zipper that is adapted to mate with said first half of a perimeter zipper and wherein said second corresponding second half of a perimeter zipper is attached to an upper edge of at least a portion of any of said four upright sides sufficient to secure said top to at least one of said upright sides when said collapsible luggage is in said first upright position.

* * * * *